US007867148B2

(12) United States Patent
Tsakiris

(10) Patent No.: US 7,867,148 B2
(45) Date of Patent: Jan. 11, 2011

(54) MODULAR HEAVY BAG WITH SPINDLE SUPPORT

(76) Inventor: Peter Tsakiris, 160 Jefferson Dr., Ocean, NJ (US) 07712

( * ) Notice: Subject to any disclaimer, the term of this patent is extended or adjusted under 35 U.S.C. 154(b) by 28 days.

(21) Appl. No.: 12/586,328

(22) Filed: Sep. 21, 2009

(65) Prior Publication Data

US 2010/0075814 A1 Mar. 25, 2010

Related U.S. Application Data

(60) Provisional application No. 61/192,751, filed on Sep. 23, 2008.

(51) Int. Cl.
*A63B 21/00* (2006.01)

(52) U.S. Cl. ..... 482/83; 482/87

(58) Field of Classification Search ..... 482/83–90; 473/441, 442; 446/491
See application file for complete search history.

(56) References Cited

U.S. PATENT DOCUMENTS 1,708,638 A * 4/1929 Smith ..... 473/442
2,197,345 A * 4/1940 Meyer ..... 132/325
5,674,157 A * 10/1997 Wilkinson ..... 482/83
6,893,384 B2 * 5/2005 Triani ..... 482/83
2007/0167297 A1 * 7/2007 Stevenson ..... 482/83
2008/0188360 A1 * 8/2008 Chu ..... 482/83

* cited by examiner

*Primary Examiner*—Jerome Donnelly
(74) *Attorney, Agent, or Firm*—Clifford G. Frayne

(57) ABSTRACT

A heavy bag for boxing, martial arts, or other athletic practice, generally cylindrical in nature having a bottom, a cylindrical vertical side wall, and an open upper end subject with closure, there being positioned within the shell, a disk member adjacent the bottom of the heavy bag, the disk member having an upwardly extending step spindle, the step spindle extending upwardly proximate the open end of the bag, there being slidably receivable on the step spindle a plurality of modular toroidal drums or cells whose central aperture is complimentary with the diameter of the particular step spindle and its outer circumference is complimentary with the internal diameter of the cylindrical shell side wall of the heavy bag, there being positioned between each of the modular toroidal drums or cells on the step spindle, a washer or disk member supported on a respective step of the spindle and providing support to the adjacent upper modular toroidal drum or cell so as to prevent compression of the lower drum and thereby contribute to a heavy bag which maintains its proper density and resilience and resistance over the height of the bag through usage and time, each drum being filled with suitable stuffing or filler.

10 Claims, 4 Drawing Sheets

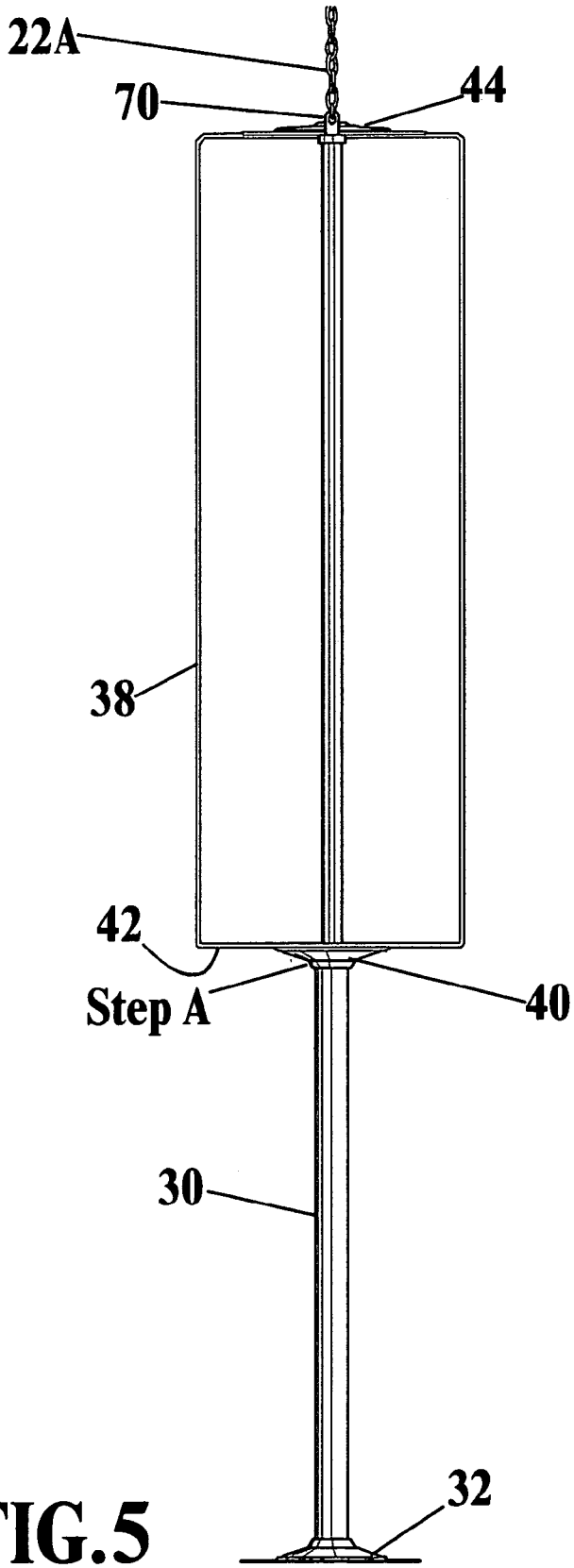
FIG.5
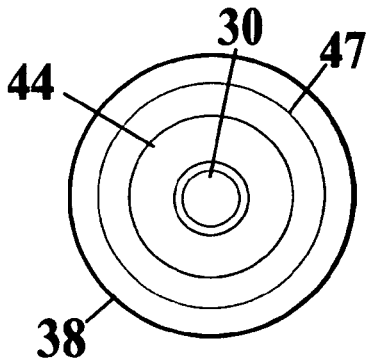
FIG.6 (Top)
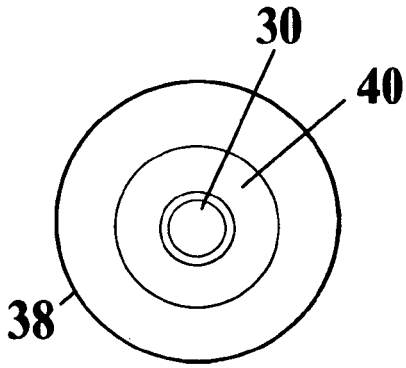
FIG.7 (Bottom)

MODULAR HEAVY BAG WITH SPINDLE SUPPORT

RELATED APPLICATIONS

Applicant claims the benefit of provisional application Ser. No. 61/192,751, filed Sep. 23, 2008.

BACKGROUND OF THE INVENTION

1. Field of the Invention

The present invention relates to exercise equipment, and more particularly, to heavy bags used in boxing, martial arts, athletic training, and for other athletic purposes, and in particular, to a heavy bag which incorporates features which prevents the sagging of the bag stuffing over time and use, and from flexing on its vertical axis from repeated blows or strikes to one area of the bag.

2. Description of the Prior Art

Heavy bags are generally vertical, longitudinal cylinders which are supported from a frame or from a ceiling. The bags are formed of a canvass, leather, or other suitable shell material which will stand up to punches, kicks and other athletic movement, as well as strikes from inanimate objects.

The heavy bags are filled with a stuffing material which can vary. Normally cut up cloth, clothing or leather is used as the stuffing filler. However, it is not unusual to find heavy bags which are stuffed with sand filler, bead filler, foam, or other energy absorbent material which provide resistance, yet some flexibility to punches, kicks and other athletic movement. Typically the heavy bag shell is filled from the top with the stuffing or filler material and then drawn tight and secured to a support apparatus such as a chain, rope, ring or the like, which in turn is secured to a bracket eyebolt or frame which supports the heavy bag at a desired height above the floor.

The bag is used by boxers, martial arts practitioners, and other athletes, and as such, the bag is struck with the hands, feet, and other anatomical parts such as the knees, elbows, and the like, as well as inanimate objects such as weapons or striking instruments. Over time the typical heavy bag experiences sagging in that under the influence of the athletic forces imposed on the outer shell and gravity, the stuffing or filling has a tendency to migrate downwardly toward the bottom of the bag. This presents a drawback to the athlete in training in that the density of the bag now varies such that punches and kicks delivered to one elevation of the bag may experience less or greater density than the same kicks applied to another level of the bag. This affects the athlete's training and may also contribute to injury since the athlete through experience expects to encounter a known resistance at different levels of the bag which the sagging of the stuffing and filler disrupts. It is therefore desirable to create a heavy bag that avoids the sagging or settling affect, and insures that the relative density and resistance experienced by the athlete in training remains the same over time. It is also desirable to provide a degree of rigidity to the bag to minimize side flexing or shape deformation due to repeated striking in one particular area of the bag. Applicant's spindle support acts as a spine to minimize these undesired effects.

OBJECTS OF THE INVENTION

An object of the present invention is to provide a novel heavy bag for athletic training in which the stuffing is modularized and supported on an internal spindle.

Another object of the present invention is to provide for a novel heavy bag in which the stuffing or filler is modularized and supported on an internal spindle and which avoids the settling or sagging of the stuffing or filler thereby contributing to a modular heavy bag which maintains its relative density and resistance over its operating length time.

Another object of present invention is to provide for a novel heavy bag in which the stuffing or filler is modularized and supported by an internal spindle, which internal spindle being vertically oriented functions as a spine and minimizes side flex and shape deformation in the bag, which is caused by repeated strikes or blows to the bag in the same general area.

A still further object of the present invention is to provide for a novel modular heavy bag which may be easily assembled and disassembled.

Another object of the present invention is to provide for a novel heavy bag which is modularized as to provide specific density customization for each individual cell.

SUMMARY OF THE INVENTION

A heavy bag for boxing, martial arts, or other athletic practice, generally cylindrical in nature having a bottom, a cylindrical vertical side wall, and an open upper end subject with closure, there being positioned within the shell, a disk member adjacent the bottom of the heavy bag, the disk member having an upwardly extending step spindle, the step spindle extending upwardly proximate the open end of the bag, there being slidably receivable on the step spindle a plurality of modular toroidal drums or cells whose central aperture is complimentary with the diameter of the particular step spindle and its outer circumference is complimentary with the internal diameter of the cylindrical shell side wall of the heavy bag, there being positioned between each of the modular toroidal drums or cells on the step spindle, a washer or disk member supported on a respective step of the spindle and providing support to the adjacent upper modular toroidal drum or cell so as to prevent compression of the lower drum and thereby contribute to a heavy bag which maintains its proper density and resilience and resistance over the height of the bag through usage and time, each drum being filled with suitable stuffing or filler.

BRIEF DESCRIPTION OF THE DRAWINGS

These and other objects of the present invention will become apparent, particularly when taken in light of the following illustrations wherein:

FIG. 5 is a front view of installed modular cylindrical drum member showing base support disk, step support disk, and top disks installed on post;

FIG. 6 is a top view of cylindrical drum member showing closure and top disk/washer;

FIG. 7 is a bottom view of cylindrical drum member with bottom support washer/disk shown;

DETAILED DESCRIPTION OF THE INVENTION

Figure 1:
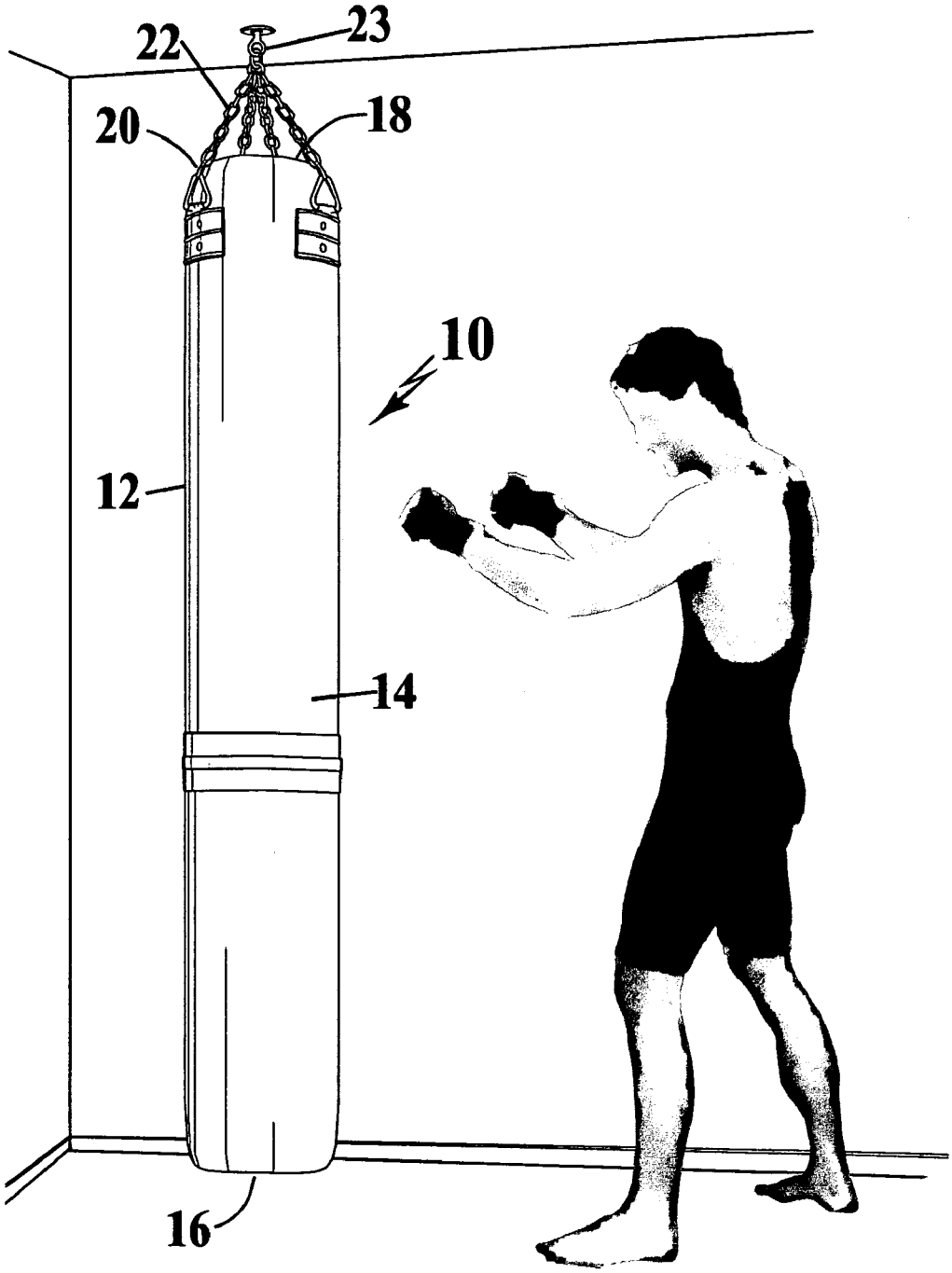
FIG. 1 is a side view of a typical heavy bag.

FIG. 1 is a side view of a typical heavy bag 10 used for athletic training. The bag consists of an outer shell 12 which when stuffed with filling such as cut up cloth, clothing, foam, or similar material, evolves into a cylindrical shape having a cylindrical side wall 14, a circular bottom wall 16, and an open top 18 which is secured after filling and stuffing is accomplished. The heavy bag has a series of contact points 20 around its upper periphery for the attachment of a support means which could be ropes, cables, or the like, which are then secured to a mounting frame 23 or the ceiling. The shell 12 is formed from leather, canvas, or other suitable material.

Ideally, the bag is stuffed with filing such that it presents a uniform density and uniform resistance from the top 18 of the bag to the bottom 16 of the bag when struck by a user. However, gravity dictates that the stuffing or filling material will settle such that through use, and time, the lower end 16 of the bag will have a density and resistance greater than the upper portion 18 of the bag. It should be noted that the heavy bags vary in length. Boxing specific bags are shorter since they are designated to be struck by the fists, while martial arts bags are longer to accommodate foot and knee strikes. The longer the bag, the more pronounced the affects of settling as the taller column of filler material creates even more internal pressure.

Figure 2:
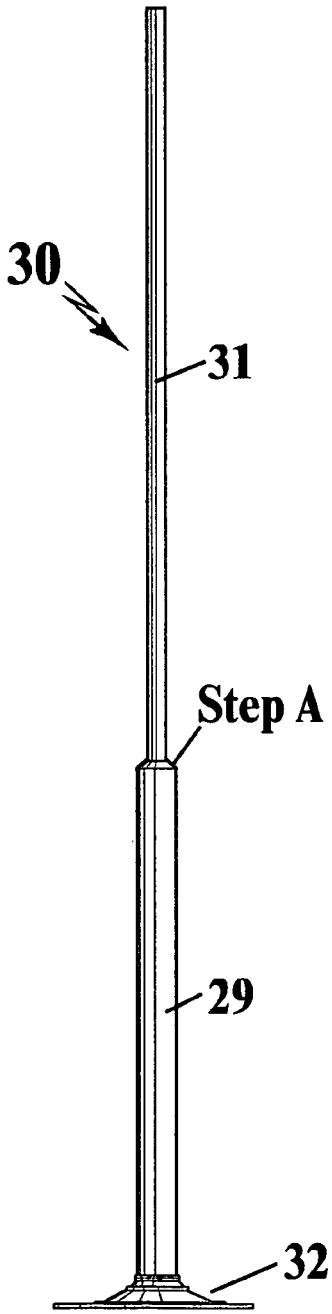
FIG. 2 is a side view of the spindle support post.

This settling affect of the heavy bag 10 could be greatly reduced by incorporating modularized segments which are individually stuffed and each module could be prevented from affecting an adjacent module thereby reducing the peak compression by providing individualized support to each modular segment. This can be accomplished with a stepped support spindle post 30 as illustrated in FIG. 2. The stepped support spindle post 30 is secured by a base member 32 which would abut the inner bottom wall 16 of heavy bag 10. Extending upwardly from the base member 32 would be a stepped support spindle post 30, which as illustrated in FIG. 2 includes a single Step A which defines a larger diameter lower portion 29 and a smaller diameter upper portion 31. Support spindle post 30 may also have a plurality of steps. The height of the stepped support spindle post 30 would approximate the height of the heavy bag 10. The support spindle post 30 is designed to receive a plurality of modular cylindrical shaped members or cells 40.

Figure 3:
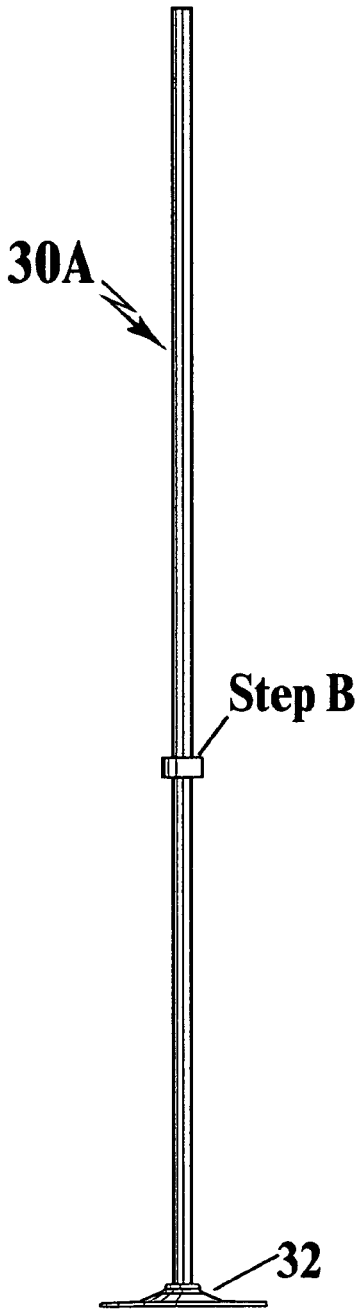
FIG. 3 is an alternate embodiment of a spindle support post.

FIG. 3 is an alternate stepped support spindle post design 30A in which the post is of a constant diameter and fixed stop member Step B divides the upper and lower portions.

Figure 4:
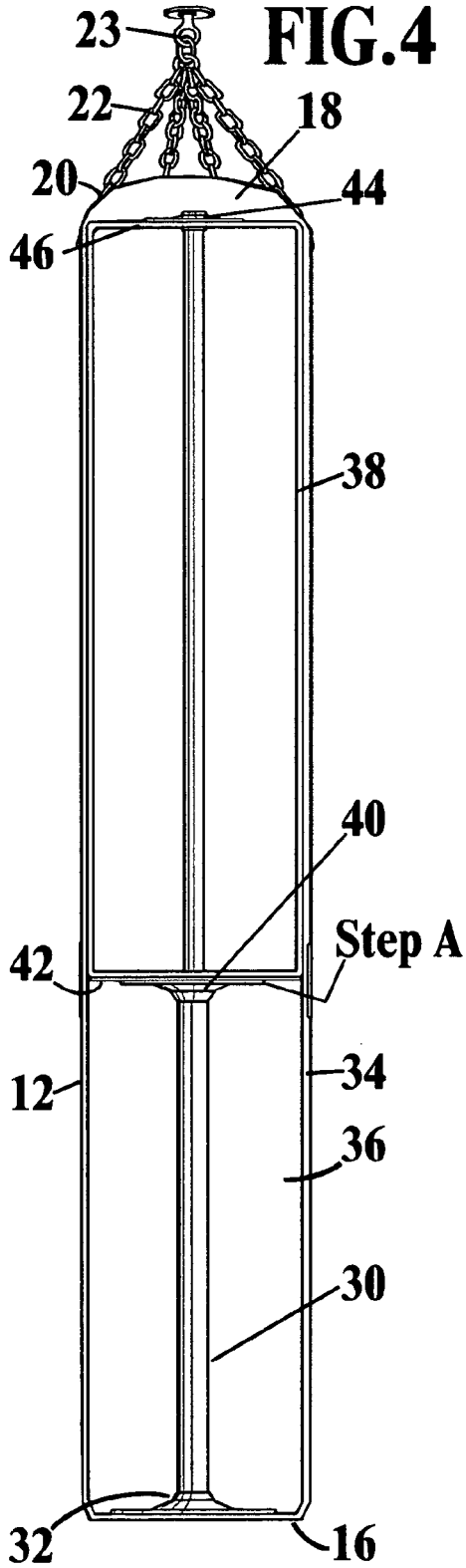
FIG. 4 is a cross-sectional view of a modular cylindrical drum member.

FIG. 4 is a cross-section of heavy bag with stepped support spindle post 30 and upper modular cell 38 installed. In this configuration stepped support spindle post 30 would be installed by securing it to the base disk 32 followed by the stuffing of a filling of lower chamber 34 with bag filler material 36 to specified compacted levels up to Step A of stepped support spindle post 30. Next an empty upper cylinder chamber module 38 would be installed by first sliding a support disk 40 attached to the bottom 42 of upper cylindrical module 38 on to Step A followed by the filling of upper cylindrical chamber module 38 while in place within bag 12. An upper disk 44 is positioned on top surface 46 of upper cylindrical chamber module 38 and attaches securely to the top of stepped support spindle post 30 keeping it centered within bag.

FIG. 5 is a front cutaway view of FIG. 4 of upper cylinder module 38 installed on stepped support spindle post 30. FIG. 6 is a top view illustrating a securable opening 47 for filling or stuffing the upper module 38. FIG. 7 is a bottom view of upper cylinder module 38 with lower support disk installed.

Figure 8:
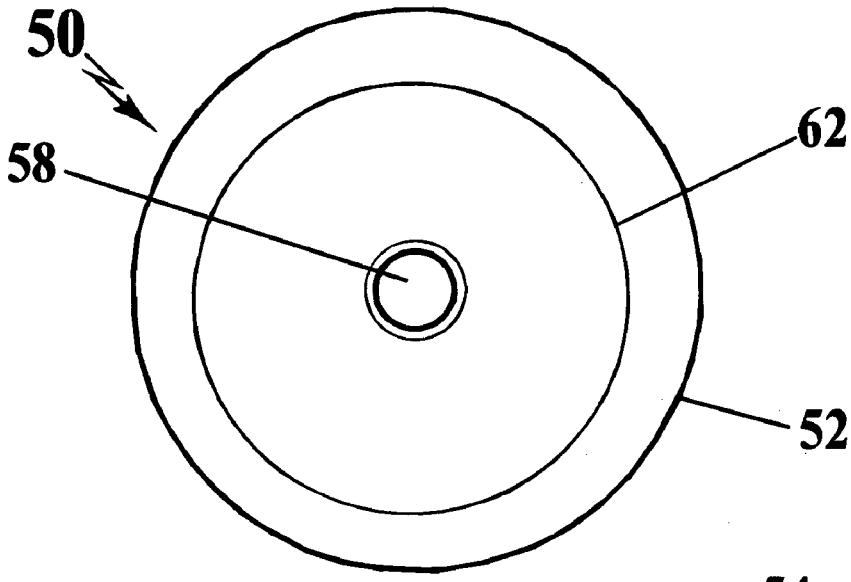
FIG. 8 is a top view of alternate toroidal drum module.
Figure 9:
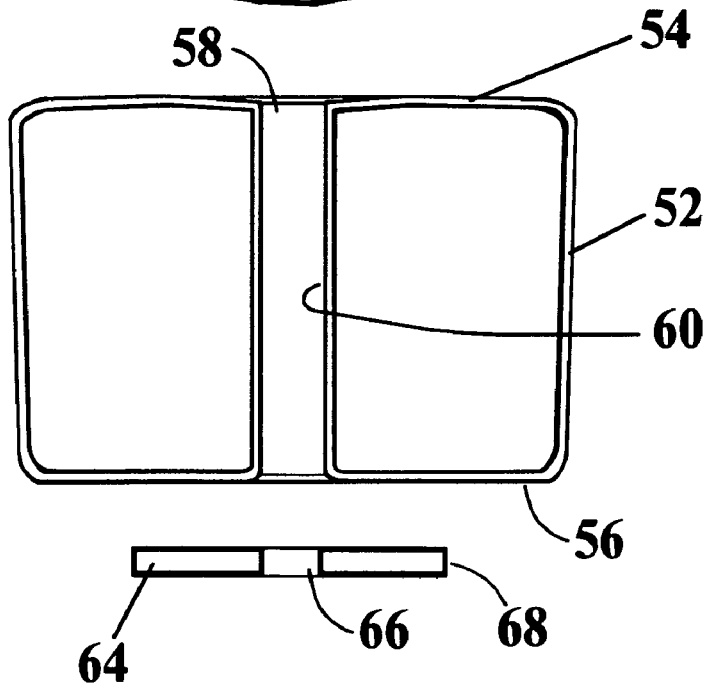
FIG. 9 is an exploded partial cross-section of the alternate toroidal drum module and support disk.
Figure 10:
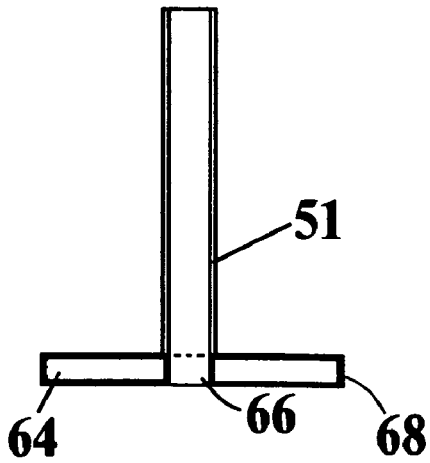
FIG. 10 is a side view of a support disk and alternative stabilizing sleeve.

FIG. 8 is a top view of alternative drum members or cells and FIG. 9 is a cross-section exploded view of its installation. It comprises a circumferential side wall 52, a top wall 54, a bottom wall 56, and a centrally disposed aperture 58 defined by an inner wall 60 and is formed of suitable liner material. The top or bottom wall 54 or 56 of the toroidal-like drum members or cells 50 would have a secured access means 62 to allow the stuffing or filling of the toroidal drum member or cell 50 with appropriate stuffing or filling. Once stuffed or filled, the toroidal drum member or cell 50 would be slidably received on spindle post 30. It will be understood that the centrally disposed aperture 58 in the toroidal drum member or cell 50 will vary depending upon whether or not that particular toroidal drum member or cell 50 is being slidably disposed on support spindle post 30 as the initial or lower toroidal drum member or cell 50 or the upper or highest toroidal drum member or cell 50. The aperture 58 in the respective toroidal drum member or cell 50 is designed to be cooperative with the diameter of a particular step on the support post.

The toroidal drum member or cell 50, when being placed on the support post are preceded on each successive step with a support washer/disk 64 having an aperture 66 cooperative with the particular diameter of the step upon which is placed and having an outer circumference 68 sufficient to provide support for the toroidal drum member or cell 50 which rests upon it. In this configuration a toroidal drum member or cell 50 oriented above another toroidal drum member or cell 50 cannot have a weight or gravitational affect on the toroidal drum member or cell 50 immediately below it since it rests upon the stepped support post 30 and cooperating washer 64.

Toroidal drum member or cell 50 as illustrated in FIGS. 8 and 9 is formed of suitable liner material including the side walls of central aperture 58. There may be instances when additional support is required to maintain the shape of cell 50. This can be accomplished with a tubular internal sleeve 51 with disk 65 insertable into aperture 58 and slidably received over spindle 30.

The support post as illustrated in FIGS. 2, 3, 4, 5 are illustrative of a single step. It will be recognized by those of ordinary skill in the art that the number of steps on stepped support spindle post 30 can vary such that less steps would require more depth for each toroidal drum member or cell 50.

Ideally, the toroidal drum members or cells 50 and respective support washers 64 would be assembled with support post 30 within shell 12 of the heavy bag 10. However, support post 30 and the assembly could be assembled outside of outer shell 12 of heavy bag 10, and then inserted.

Additional support to the heavy bag to prevent sagging may also be accomplished by forming stepped support spindle post 30 with an aperture or hook 70 at its upper end for an additional support means 22A similar to the support means 22 which support the heavy bag from contact points 20. This support means 22A would be secured to the same mounting frame as the heavy bag, and would produce an upward pressure on stepped support spindle post 30, base member 32, and any intervening disks which may be mounted on stepped support spindle post 30 for support of an adjacent stuffing module.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. A heavy bag for use in boxing, the martial arts, or other athletic exercises, the heavy bag comprising:

a cover shell having an outer wall and an inner wall, the cover shell circumferential in shape defining a cylindrical chamber having a bottom wall and a securable upper end, the shell cover having a suspension means secured to its upper end for attachment to a mounting member;

an internal stepped spindle positioned within said cover shell having a base member juxtaposed said bottom wall of said cover shell, said stepped spindle extending vertically upwardly therefrom towards said upper end, each step of said stepped spindle supporting a horizontal support disk, each of said support disks having an aperture corresponding to the diameter of the spindle proximate said step, said internal stepped spindle maintaining vertical integrity of said heavy bag;

a plurality of modular stuffed canisters having a toroidal shape, each canister having an aperture dimension corresponding to a dimension of said stepped spindle, said modular stuffed canisters stacked on said stepped spindle within said cylindrical chamber of said cover shell, each of said modular stuffed canisters separated from said adjacent modular stuffed canister by said disk member.

2. The heavy bag in accordance with claim 1 wherein said cover shell is directly stuffed with stuffing material from said bottom wall to a first step of said internal stepped spindle, said stacking of said modular stuff canisters commencing on said first step of said internal stepped spindle.

3. The heavy bag in accordance with claim 1 wherein each of said modular stuffed canisters is formed of a casing having a cylindrical side wall, planar upper wall, and planar lower wall, and a cylindrical inner wall thereby defining a cavity for the receipt of stuffing material.

4. The heavy bag in accordance with claim 1 wherein the outer toroidal surface of said modular stuffed canisters abuts the inner wall of said shell cover imparting a cylindrical shape to said heavy bag.

5. The heavy bag in accordance with claim 1 wherein each of said modular stuffed canisters has a securable opening to allow for the positioning of stuffing materials therein.

6. The heavy bag in accordance with claim 1 wherein said modular stuffed canisters are filled with a stuffing material, said stuffing material selected from a group consisting of sand, pieces of cut cloth, clothing, gel, liquid, foam, rubber, particles or pellets of rubber and egg foam.

7. The heavy bag in accordance with claim 1 wherein said stuffing materials can be positioned within said canisters to vary the density and hardness of the respective canisters.

8. The heavy bag in accordance with claim 1 wherein said diameter of said support disks is less than the diameter of said stuffed canisters.

9. The heavy bag in accordance with claim 1 wherein the outer circumferential edge of said support disks are cushioned by an overlap of said stuffed canister positioned above said respective support disk.

10. The heavy bag in accordance with claim 1 wherein a support means secured to said upper end of said stepped spindle is secured to an overhead bracket with said suspension means of said cover shell, said support means providing vertical support to said stepped spindle and said support disks and to said stuffed canisters minimizing sag of said canisters and maintaining desired vertical densities within said heavy bag.

* * * * *